United States Patent [19]

Yagupov

[11] 4,238,078

[45] Dec. 9, 1980

[54] APPARATUS FOR DISINTEGRATING A LUMPED MATERIAL

[75] Inventor: Alexandr V. Yagupov, Ordzhonikidze, U.S.S.R.

[73] Assignee: Severo-Kavkazsky Gorno-Metallurgichesky Institute, U.S.S.R.

[21] Appl. No.: 22,995

[22] Filed: Mar. 22, 1979

Related U.S. Application Data

[62] Division of Ser. No. 848,723, Nov. 4, 1977, Pat. No. 4,176,795.

[51] Int. Cl.[3] ..... B02C 23/36

[52] U.S. Cl. ..... 241/46.02; 241/46.17; 241/284

[58] Field of Search ..... 241/1, 18, 21, 26, 27, 241/46.02, 41, 46 R, 46.17, 220, 244, 258, 277, 278 R, 284, 301

[56] References Cited

U.S. PATENT DOCUMENTS

| | | | |
|---|---|---|---|
| 288,724 | 11/1883 | Newsom | 241/284 |
| 327,501 | 9/1885 | Sturtevant | 241/284 X |

*Primary Examiner*—Mark Rosenbaum

*Attorney, Agent, or Firm*—Robert E. Burns; Emmanuel J. Lobato; Bruce L. Adams

[57] ABSTRACT

Apparatus for disintegrating lumped materials into smaller particles. The apparatus makes provision for containing a vertical column of a lumped material to be disintegrated and which is held stationary and continuously replenished. A conical bowl rotatably driven receives a lowermost portion of the vertical column and rotates it. A zone is developed immediately above the rotated lower portion of the vertical column in which the lumps of the material impact each other and disintegrate each other.

4 Claims, 3 Drawing Figures

APPARATUS FOR DISINTEGRATING A LUMPED MATERIAL

This is a divisional of application Ser. No. 848,723, filed Nov. 4, 1977, now U.S. Pat. No. 4,176,795.

BACKGROUND OF THE INVENTION:

The present invention relates to methods of working friable materials, and, more particularly, it relates to a method and apparatus for disintegrating materials, for instance, ores of ferrous and non-ferrous metals.

The invention can be utilized by various industries where raw materials are worked, e.g. by the mining industry, metallurgy of ferrous and non-ferrous metals, the chemical industry, etc.

Processes of crushing and grinding friable materials are broadly utilized by various industries using raw materials and working them by various methods in all types of equipment.

The most widely utilized technique of disintegrating or reducing a material is its autogenous reduction in a confined space, e.g. in a rotating drum. According to this technique, lumps of the material are lifted in the vessel to a certain height, to fall therefrom by gravity and thus to disintegrate themselves.

A whole range of mills has been created, utilizing this technique.

A disadvantage of the method of autogenous disintegration of a material is its inherent relatively low specific throughput and inadequate efficiency. This is explained by the fact that the material is to be lifted to a certain height, so as to supply it with an amount of energy sufficient for its self-disintegration.

There is also known a method of distintegrating a material accelerated in a centrifugal bowl-shaped rotor and directed against deflection plates effecting its disintegration.

However, this method has a number of disadvantages. Among them is relatively high energy consumption, and also excessive wear of the assemblies and components of the structure, having to withstand impact loads.

SUMMARY OF THE INVENTION

The main object of the present invention is to provide a method of continuous disintegration of a material by dynamic loads, which should increase the intensity and efficiency of the process.

It is another object of the present invention to provide an apparatus for dynamic disintegration of a material, which should be of a simple construction and offer high throughput.

It is also an object of the present invention to reduce the specific amount of metal in an apparatus for disintegrating materials.

It is still another object of the present invention to provide an apparatus with a relatively low level of noise produced by an operation of disintegrating a material.

These and other objects are attained in a method of disintegrating a material by repeated impacts of its components against one another in a confined space, including, in accordance with the present invention, forming a continuously fed material into a cylindrical vertical column, rotating the lower portion of this column by means of a rotor shaped as a truncated cone of which the angular speed is such that the upward pressure created by the vertical component of the centrifugal force exceeds the downward pressure brought about by the weight of the thus formed column, whereby there is created an active horizontal disintegration zone, wherein there takes place dynamic action upon the material being disintegrated and a varying gradient of the circumferential speed of its components.

It is expedient that the circumferential speed at the periphery of the rotor should be set within a range from 10 to 70 m/s, to provide for dynamic action upon the material in the active disintegration zone.

It is also expedient that the pressure of the column of the material at the level of the uppermost surface of the rotor should be maintained within a range from 0.05 to 0.15 MPa.

The present invention further provides an apparatus capable of performing the aforementioned method, comprising a vertically arranged cylindrical housing with a shaft concentrically accommodated therein, supporting a bowl-shaped rotor, and a drive, in which apparatus, in accordance with the invention, there is mounted above the rotor, concentrically with the shaft, a hollow cylinder interconnected with the housing by vertical partitions dividing the working space of the housing into a series of adjoining chambers, the rotor per se being arranged with respect of the partitions of the housing so that a horizontal zone of the active disintegration of the material is defined therebetween, the internal space of the said rotor being made up of sections, the lower portion of each section having an aperture made therethrough for supplying a carrier fluid in the active material disintegration zone.

It is expedient that the sections of the rotor should be defined by vertical partitions providing for acceleration of the material.

It is further expedient that an annular conical lug should be provided on the housing about the periphery of the active disintegration zone.

The apparatus of the above specified general structure provides for intense disintegration of a material with minimum energy consumption.

The essence of the invention is, as follows. The material (FIG. 1) is continuously fed into the apparatus of which the rotor is rotated by the drive means and rotates, in its turn, the lower portion of a cylindrical vertical column (a) of the material, confined in the apparatus performing the method.

The material in the conical rotor is acted upon by centrifugal forces of which the value is determined by the angular speed the mass of an individual lump and the distance from the axis of rotation, i.e.

$$C=m\omega^2 \cdot r,$$

wherein C is a centrifugal force acting upon an individual lump of the material, having the mass "m" and rotated at an angular speed "$\omega$" at the distance "r" from the axis of rotation.

With the "m" and "r" values being constant, the value of the centrifugal force acting upon an individual lump is proportional to square angular speed of the rotor, its vertical component equalling:

$$C \cdot tg\alpha,$$

wherein "$\alpha$" is the angle defined by the rotor wall and a horizontal plane. With $\alpha=45°$, the vertical component of the centrifugal force is numerically equal to its absolute value.

By setting the angular speed of rotation of the rotor so that the pressure of the vertical component of the centrifugal source at the external wall of the rotor should exceed the pressure of the column (a) confined in the apparatus, to ensure permanent replacement of the material in the active zone (b).

The dynamic action is exerted upon the material in the active zone (b) by the rotating rotor, which transmits pulses of force to lumps of the material moving at different speeds. Lumps of the material, getting from the lower portion of the column into the sections of the rotor, are accelerated by the vertical partitions of the rotor and sent into the active zone, the lumps having kinetic energy equalling $mw^2/2$, wherein m is the mass of a lump, and $\omega$ is the circumferential speed equalling the product of the angular speed of the rotor by the radius of rotation of the lump.

Since the lump driven by the centrifugal force into the active zone encounters therein the bulk of the material, it spends its kinetic energy on destruction of this material and delivering thereto an effort of force, resulting in the material moving in the active zone.

The centrifugal force acting upon the material within the rotor is directly proportional to the radius of rotation, its minimum value is adjacent to the axis of rotation, and the maximum value is next to the periphery of the rotor. Therefore, the particles and lumps of ore move away from the axis of rotation, toward the periphery of the rotor and are lifted therein, whereby continuous renewal of the material in the active disintegration zone takes place.

The material disintegration duty in the active zone is defined by the gradient of speed of the material in this active zone and by the pressure thereupon of the column of the material in the apparatus.

The circumferential speed at the periphery of the rotor is preferably set within a range from 10 to 70 m/s, whereby it is ensured that the material is dynamically acted upon in the active disintegration zone. The optimum value of the circumferential speed for a material with given physical and mechanical properties is selected on the basis of test data obtained by experimenting with the parameters of the process.

The pressure of the material column at the level of the uppermost plane at the rotor is preferably maintained within a range from 0.05 to 0.15 MPa, which corresponds to a 2.5 to 7.5 m height of the column of material of $2.10^3$ kg/m$^3$ specific density.

When the material is particularly weak, the lower limit of the pressure may be lowered to 0.02 MPa.

Thus, the presently disclosed invention enhances the efficiency of the process of disintegration of a material, while at the same time substantially reducing the specific energy consumption, owing to the material having applied thereto intense dynamic loads transmitted by the particles and lumps of the material to one another.

Furthermore, the amount of steel used to make the apparatus is reduced is likewise, reduced, devoid as the apparatus performing the method is of grinding bodies and armour plates, to say nothing of the better working conditions of the components of the structure, engaged by the material being disintegrated.

Moreover, the amount of metal in the construction of the disintegrating apparatus is reduced,, and the driving pattern thereof is simplified, which also enhances the efficiency of the process.

Worth mentioning is also the relatively low level of noise produced by the operating apparatus in accordance with the invention.

BRIEF DESCRIPTION OF THE DRAWINGS

Other objects and advantages of the present invention will become apparent from the following detailed description of the performance of the herein disclosed method by an apparatus for disintegrating a material, with reference being had to the accompanying drawings, wherein.

DESCRIPTION OF THE PREFERRED EMBODIMENTS

Figure 1:
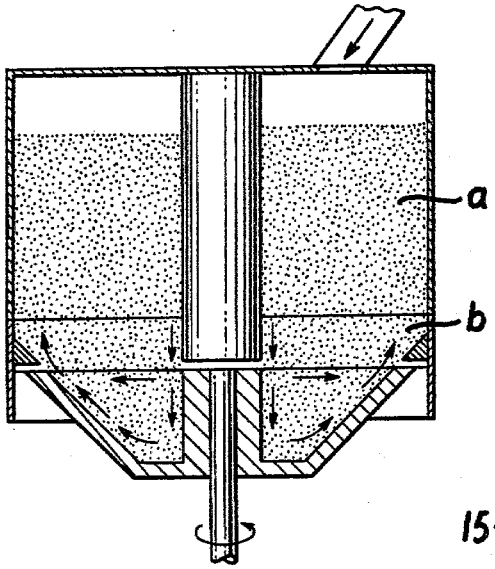
FIG. 1 illustrates the principle of disintegration of a material, in accordance with the invention.
Figure 2:
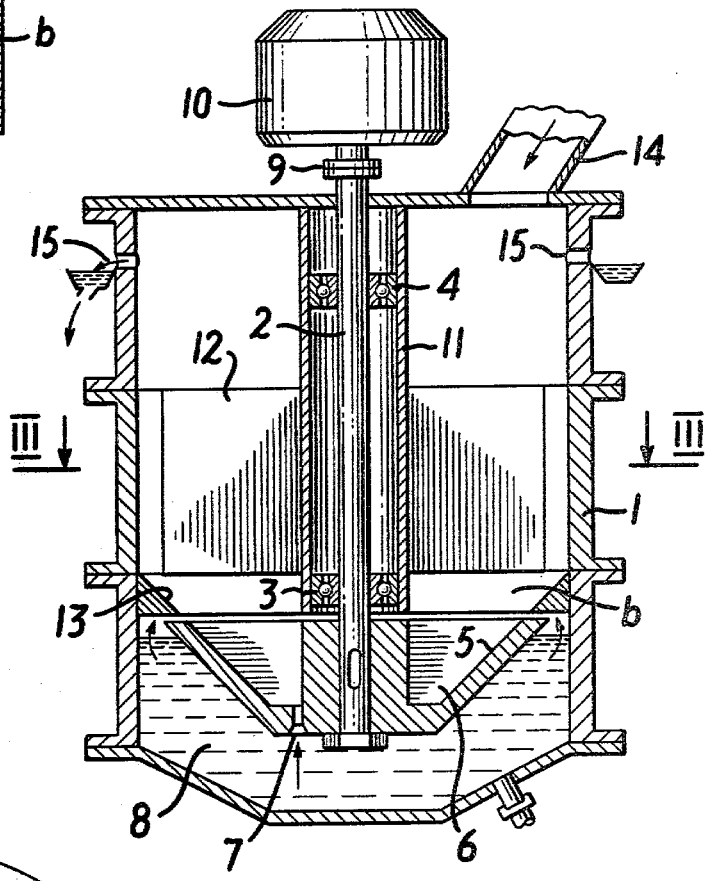
FIG. 2 is a longitudinal sectional view of the apparatus for disintegrating a material, embodying the invention.
Figure 3:
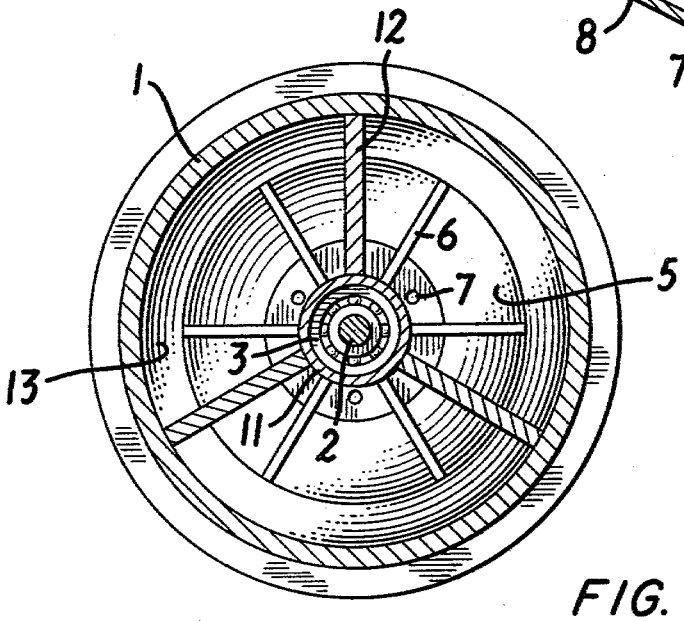
FIG. 3 is a sectional view taken on section line III—III of FIG. 2.

Referring now to the drawings, the apparatus (FIGS. 2 and 3) comprises a vertical cylindrical steel housing 1 concentrically and a coaxially accommodating therein a shaft 2 journalled in bearing assemblies 3 and 4. The shaft 2 has mounted thereon a bowl-shaped rotor 5 shaped as a truncated cone. The internal space of the rotor 5 is divided into sections by vertical partitions 6. In the lower portion of each section there is provided an aperture 7 for feeding therethrough a pressurized carrier fluid (e.g. a liquid or gas) from a container 8 into the respective section of the rotor 5. Mounted above the rotor 5 concentrically with the shaft 2 is a hollow cylinder 11 interconnected with housing 1 by vertical partitions 12 dividing the working space of the housing 1 into a plurality of adjoining chambers. The uppermost end of the shaft 2 is connected by means of a coupling 9 with a drive 10 adapted to rotate the rotor 5. The rotor 5 is so arranged with respect of the partitions 12 of the housing 1, that a zone "b" is left therebetween for active disintegration of the material. Secured to the housing 1 about the periphery of this active disintegration zone is a conical lug 13 protecting the topmost exposed surface of the rotor from engagement with lumps of the material being disintegrated.

The apparatus operates, as follows: the rotor 5 is put in rotation by the drive motor, and the material to be disintegrated is continuously fed into the working space of the housing 1 via a feed pipe 14, the material including both relatively big lumps and small particles. The greater portion of the working space of the housing 1 is thus permanently filled with the material confined in a cylindrical vertical column continuously replenished by the feed means (not shown), and also by the material in the form of either a pulp or a fluidized mass, continuously delivered out of the apparatus via the delivery passage 15.

In the active disintegration zone "b" defined intermediate the topmost plane of the rotor 5 and the vertical partitions 12 of the housing 1 there takes place intense crushing and disintegration of the material, resulting from swift relative motion of layers and lumps striking one another and moving with respect of one another.

This actively disintegrated layer is permanently renewed, since the action of the centrifugal forces upon its peripheral zone overcomes the weight of the column and lifts the material therein, while the innermost portions of the active layer descend to fill in the spaces evacuated in the sections of the rotating rotor. Disintegrated particles of the material are taken up by the ascending flow of the carrier fluid and are delivered from the working space of the apparatus either as a liquid suspension or pulp, or a gas-fluidized mass.

The rate of the delivery of the material is interdependent with its feed rate, so that the height of the material column in the working space of the apparatus is maintained practically at the same level, preset in accordance with the required conditions of the process.

To provide for continuous circulation of the material and for continuous renewal of the active layer, the upward pressure produced by the centrifugal action at the periphery of the bowl of the rotor should be higher than the downward pressure of the vertical column of the material, which is ensured by selecting an appropriate angular speed of the rotor 5.

In the herein disclosed apparatus the major portion of the supplied energy is spent on disintegrating the material in the active zone intermediate the rotating rotor and the vertical partitions of the housing. Consequently, the consumption of energy by disintegration of a material is substantially lower than in hitherto known ore mills wherein considerable amounts of energy are spent on lifting, moving and deforming permanent grinding bodies, linings or deflector plates.

The present invention can be utilized with high effectiveness in ore concentration plants where ferrous and non-ferrous ores are treated.

What is claimed is:

1. Apparatus for disintegrating lumped solid materials into smaller particles comprising, means for continuously feeding into a vertical column a lumped solid material which can be reduced by disintegration into solid smaller particles, means for directly rotating about the axis of said column of material a lowermost portion of said column of material and with a velocity gradient increasing away from the axis and at a maximum rotational speed remote from said axis effective to develop an active horizontal disintegration zone immediately above said lowermost portion of the vertical column of said material in which lumps of said material impact each other directly and the lumped solid material is disintegrated, means for simultaneously flowing disintegrated solid material from said lower portion outwardly and upwardly along the periphery of said column to continuously allow entry of lumped solid material into said disintegration zone, and disintegrated solid material into said lower portion, while simultaneously flowing the disintegrated solid material away from said column, means for holding all of said lumped solid material in said column above the level of said disintegration zone and holding it from rotation, and means for continuously maintaining a pressure head of said lumped solid material on said solid material in said zone by continuously replenishing said column above the level of said zone.

2. Apparatus for disintegrating lumped solid material into smaller particles according to claim 1, in which said means for simultaneously flowing disintegrated solid material from said lower portion of said column comprises means to introduce a fluid under pressure into said lowermost portion of said column of material to flow said disintegrated material as a flow along said periphery of the column.

3. Apparatus for disintegrating lumped solid material into smaller particles according to claim 2, including means to continuously remove the last mentioned flow of disintegrated material from said column.

4. Apparatus for disintegrating lumped solid material into smaller particles according to claim 1, in which said means for directly rotating lowermost portion of said column comprises means to impart kinetic energy to said material in said lowermost portion of said column that is proportional to the square of the angular velocity of rotation of said lower portion, and said energy being expended in disintegrating the lumped material in said zone.

* * * * *